US005679232A

United States Patent [19]

Fedor et al.

[11] Patent Number: 5,679,232

[45] Date of Patent: Oct. 21, 1997

[54] PROCESS FOR MAKING WIRE

[75] Inventors: Robert J. Fedor, Westlake; Peter Peckham, Concord, both of Ohio; Sharon K. Young; Michael A. Eamon, both of Tucson, Ariz.; Roger N. Wright, Rexford, N.Y.; Stephen J. Kohut, Chandler, Ariz.; Craig J. Hasegawa, Willoughby, Ohio; Susan S. Enos, Tucson, Ariz.; Robert D. DeWitt, Highland Heights, Ohio

[73] Assignee: ElectroCopper Products Limited, Chandler, Ariz.

[21] Appl. No.: 634,271

[22] Filed: Apr. 18, 1996

Related U.S. Application Data

[63] Continuation-in-part of Ser. No. 329,235, Oct. 26, 1994, Pat. No. 5,516,408, which is a continuation-in-part of Ser. No. 49,176, Apr. 19, 1993, Pat. No. 5,366,612, and Ser. No. 287,703, Aug. 9, 1994, Pat. No. 5,458,746, which is a continuation of Ser. No. 49,160, Apr. 19, 1993, abandoned.

[51] Int. Cl.[6] ..... C25D 1/04

[52] U.S. Cl. ..... 205/77; 29/17.8; 29/17.2; 29/413; 29/412

[58] Field of Search ..... 205/77; 29/412, 29/413, 17.1, 17.2, 17.8, DIG. 12, DIG. 33

[56] References Cited

U.S. PATENT DOCUMENTS

| | | | |
|---|---|---|---|
| 440,548 | 11/1890 | Elmore | 205/73 |
| 1,058,048 | 4/1913 | Gibbs | 205/138 |
| 2,074,713 | 10/1937 | Tross | 29/216 |
| 3,556,957 | 1/1971 | Toledo et al. | 204/32 |
| 3,683,662 | 8/1972 | Dechene et al. | 72/235 |
| 3,799,859 | 3/1974 | Wallin | 204/216 |
| 3,811,309 | 5/1974 | Nordstrom | 72/235 |
| 3,929,610 | 12/1975 | Wang | 204/13 |
| 3,939,745 | 2/1976 | Weeks et al. | 83/425.3 |
| 4,018,073 | 4/1977 | Bartram et al. | 72/199 |
| 4,037,445 | 7/1977 | Winter et al. | 72/60 |
| 4,083,758 | 4/1978 | Hamby et al. | 204/106 |
| 4,193,846 | 3/1980 | Barrett | 204/13 |
| 4,891,105 | 1/1990 | Sein | 204/28 |
| 4,956,053 | 9/1990 | Polan | 205/96 |
| 5,031,432 | 7/1991 | Loesch et al. | 72/13 |
| 5,060,499 | 10/1991 | Poloni | 72/201 |
| 5,066,366 | 11/1991 | Lin | 204/12 |
| 5,086,634 | 2/1992 | Richards | 72/161 |
| 5,215,645 | 6/1993 | DiFranco et al. | 205/77 |
| 5,238,048 | 8/1993 | Hackman | 164/463 |
| 5,366,612 | 11/1994 | Clouser et al. | 205/73 |
| 5,421,985 | 6/1995 | Clouser | 205/77 |
| 5,454,926 | 10/1995 | Clouser | 205/50 |
| 5,516,408 | 5/1996 | Peckham | 205/580 |

OTHER PUBLICATIONS

PCT/US96/18040, PCT International Search Report mailed Apr. 28, 1997.

G.D. Bucci et al, Copper Foil Technology, "After The Base Foil Production, The Base Material Is Subjected To A Variety Of Treatment Processes", PC FAB, Jul., 1986, pp. 22, 27–30, 33.

W.H. Safranek et al, "Fast Rate Electrodeposition", Transactions of the Insitute of Metal Finishing , 1975, vol. 53.

D.J. Arrowsmith, "Adhesion of Electroformed Copper and Nickel to Plastic Laminates", Transactions of the Institute of Metal Finishing, 1970, vol. 48.

CS Analysis: Electrowon Cathode Quality, "Electrowon Cathode Takes Growing Share of Wiremill Market, CRO Copper Studies", vol. 18, No. 10, Apr. 1991.

(List continued on next page.)

*Primary Examiner*—Jey Tsai
*Assistant Examiner*—Brendan Mee
*Attorney, Agent, or Firm*—Michael A. Centanni

[57] ABSTRACT

This invention relates to a process for making metal wire, comprising: (A) forming metal foil; (B) cutting said foil to form at least one strand of metal wire; and (C) shaping said strand of wire to provide said strand with desired cross-sectional shape and size. This process is particularly suitable for making copper wire, especially copper wire having a very thin diameter (e.g., about 0.0002 to about 0.02 inch).

28 Claims, 3 Drawing Sheets

OTHER PUBLICATIONS

17447, "High Speed Tinning–Line for Copper Wire", Tin and Its Uses, (59), 4–6 (1963).

17448, Makowski et al, "Properties of Electrodeposited Foils for Use in Printed Circuits" Paper from Symposium on Electrodeposited Metals as Materials for Selected Applications. Jan. 1972, pp. 14–31.

24051, Coppertron, "An Installation For And Method Of Electrolytic Production Of Copper Foil", British Patent 1,588,681 (Apr. 29, 1981).

PROCESS FOR MAKING WIRE

This application is a continuation-in-part of U.S. application Ser. No. 329,235, filed Oct. 26, 1994 (now U.S. Pat. No. 5,516,408); which was a continuation-in-part of Ser. No. 49,176, filed Apr. 19, 1993 (now U.S. Pat. No. 5,366,612), and a continuation-in-part of Ser. No. 287,703 filed Aug. 9, 1994 (now U.S. Pat. No. 5,458,746) which was a continuation of Ser. No. 49,160, filed Apr. 19, 1993 (now abandoned). The disclosures in these prior applications are incorporated herein by reference in their entirety.

TECHNICAL FIELD

This invention relates to a process for making wire. More particularly, this invention relates to a process for making wire by the steps of forming metallic foil, then cutting the foil to form one or more strands of wire, and shaping the strands to provide the wire with a desired cross sectional shape and size. This invention is particularly suitable for making copper wire.

BACKGROUND OF THE INVENTION

The conventional method for making copper wire involves the following steps. Electrolytic copper (whether electrorefined, electrowon, or both) is melted, cast into bar shape, and hot rolled into a rod shape. The rod is then cold-worked as it is passed through drawing dies that systematically reduce the diameter while elongating the wire. In a typical operation, a rod manufacturer casts the molten electrolytic copper into a bar having a cross section that is substantially trapazoidal in shape with rounded edges and a cross sectional area of about 7 square inches; this bar is passed through a preparation stage to trim the comers, and then through 12 rolling stands from which it exits in the form of a 0.3125" diameter copper rod. The copper rod is then reduced to a desired wire size through standard round drawing dies. Typically, these reductions occur in a series of machines with a final annealing step and in some instances intermediate annealing steps to soften the worked wire.

The conventional method of copper wire production consumes significant amounts of energy and requires extensive labor and capital costs. The melting, casting and hot rolling operations subject the product to oxidation and potential contamination from foreign materials such as refractory and roll materials which can subsequently cause problems to wire drawers generally in the form of wire breaks during drawing.

By virtue of the inventive process, metal wire is produced in a simplified and less costly manner when compared to the prior art. In one embodiment, the inventive process utilizes a copper source such as copper shot, copper oxide or recycled copper; this process does not require use of the prior art steps of first making copper cathodes then melting, casting and hot rolling the cathodes to provide a copper rod feedstock.

SUMMARY OF THE INVENTION

This invention relates to a process for making metal wire, comprising: (A) forming metal foil; (B) cutting said foil to form at least one strand of wire; and (C) shaping said strand of wire to provide said strand with desired cross-sectional shape and size. This invention is particularly suitable for making copper wire, especially copper wire with a very thin or ultra thin diameter, for example, diameters in the range of about 0.0002 to about 0.02 inch.

BRIEF DESCRIPTION OF THE DRAWINGS

In the annexed drawings, like parts and features are designated by like reference numerals.

DESCRIPTION OF THE PREFERRED EMBODIMENTS

Figure 1:
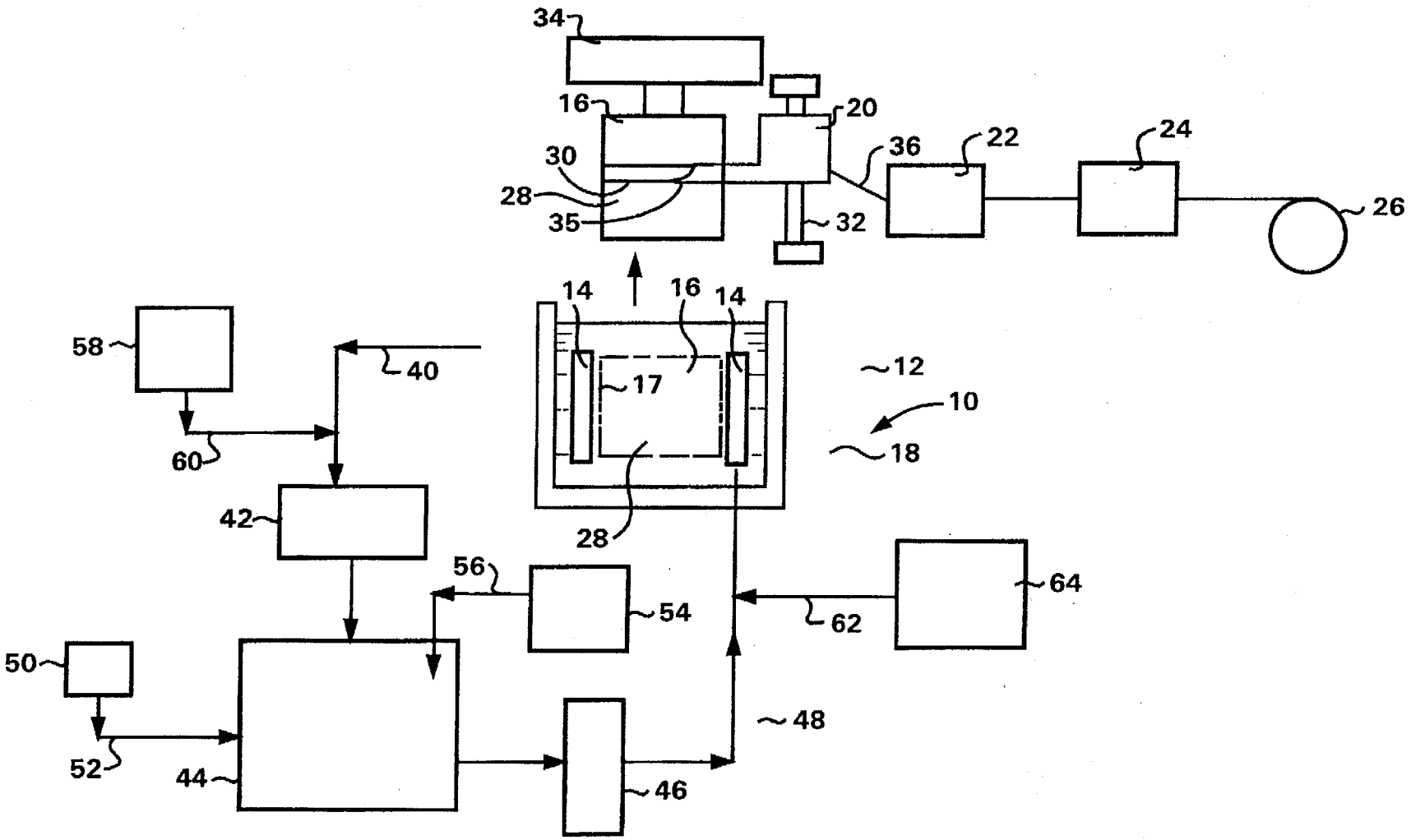
FIG. 1 is a flow sheet illustrating one embodiment of the invention wherein copper is electrodeposited on a vertically oriented cathode to form copper foil, the foil is score cut and removed from the cathode as a strand of copper wire, and then the copper wire is shaped to provide the copper wire with a desired cross-sectional shape and size.

The wire that is made in accordance with the inventive process can be made of any metal or metal alloy that can be initially formed into a metallic foil. Examples of such metals include copper, gold, silver, tin, chromium, zinc, nickel, platinum, palladium, iron, aluminum, steel, lead, brass, bronze, and alloys of the foregoing metals. Examples of such alloys include copper/zinc, copper/silver, copper/tin/zinc, copper/phosphorus, chromium/molybdenum, nickel/chromium, nickel/phosphorous, and the like. Copper and copper-based alloys are especially preferred.

The metallic foils are made using one of two techniques. Wrought or rolled metallic foil is produced by mechanically reducing the thickness of a strip or ingot of the metal by a process such as rolling. Electrodeposited foil is produced by electrolytically depositing the metal on a cathode drum and then peeling the deposited strip from the cathode.

The metal foils typically have nominal thicknesses ranging from about 0.0002 inch to about 0.02 inch, and in one embodiment about 0.004 to about 0.014 inch. Copper foil thickness is sometimes expressed in terms weight and typically the foils of the present invention have weights or thicknesses ranging from about ⅛ to about 14 oz/ft$^2$. Useful copper foils are those having weights of about 3 to about 10 oz/ft$^2$. Electrodeposited copper foils are especially preferred.

In one embodiment, electrodeposited copper foil is produced in an electroforming cell equipped with a cathode and an anode. The cathode can be vertically or horizontally mounted and is in the form of a cylindrical mandrel. The anode is adjacent to the cathode and has a curved shape conforming to the curved shape of the cathode to provide a uniform gap between the anode and the cathode. The gap between the cathode and the anode generally measures from about 0.3 to about 2 centimeters. In one embodiment, the anode is insoluble and made of lead, lead alloy, or titanium coated with a platinum family metal (i.e., Pt, Pd, Ir, Ru) or oxide thereof. The cathode has a smooth surface for receiving the electrodeposited copper and the surface is, in one embodiment, made of stainless steel, chrome plated stainless steel or titanium.

In one embodiment, electrodeposited copper foil is formed on a horizontally mounted rotating cylindrical cathode and then is peeled off as a thin web as the cathode rotates. This thin web of copper foil is cut to form one or more strands of copper wire, and then the strands of copper wire are shaped to provide a desired cross-sectional shape and size.

In one embodiment, copper foil is electrodeposited on a vertically mounted cathode to form a thin cylindrical sheath of copper around the cathode. This cylindrical sheath of copper is score cut to form a thin strand of copper wire which is peeled off the cathode and then shaped to provide a desired cross-sectional shape and size.

In one embodiment, a copper electrolyte solution flows in the gap between an anode and a cathode, and an electric current is used to apply an effective amount of voltage across the anode and the cathode to deposit copper on the cathode. The electric current can be a direct current or an alternating current with a direct current bias. The velocity of the flow of the electrolyte solution through the gap between the anode and the cathode is generally in the range of about 0.2 to about 5 meters per second, and in one embodiment about 1 to about 3 meters per second. The electrolyte solution has a free sulfuric acid concentration generally in the range of about 70 to about 170 grams per liter, and in one embodiment about 80 to about 120 grams per liter. The temperature of the electrolyte solution in the electroforming cell is generally in the range of about 25° C. to about 100° C., and in one embodiment about 40° C. to about 70° C. The copper ion concentration is generally in the range of about 40 to about 150 grams per liter, and in one embodiment about 70 to about 130 grams per liter, and in one embodiment about 90 to about 110 grams per liter. The free chloride ion concentration is generally up to about 300 ppm, and in one embodiment up to about 150 ppm, and in one embodiment up to about 100 ppm. In one embodiment, the free chloride ion concentration is up to about 20 ppm, and in one embodiment up to about 10 ppm, and in one embodiment up to about 5 ppm, and in one embodiment up to about 2 ppm, and in one embodiment up to about 1 ppm. In one embodiment, the free chloride ion concentration is less than about 0.5 ppm, or less than about 0.2 ppm, or less than about 0.1 ppm, and in one embodiment it is zero or substantially zero. The impurity level is generally at a level of no more than about 20 grams per liter, and typically no more than about 10 grams per liter. The current density is generally in the range of about 50 to about 3000 amps per square foot, and in one embodiment about 400 to about 1800 amps per square foot.

In one embodiment, copper is electrodeposited using a vertically mounted cathode rotating at a tangential velocity of up to about 400 meters per second, and in one embodiment about 10 to about 175 meters per second, and in one embodiment about 50 to about 75 meters per second, and in one embodiment about 60 to about 70 meters per second. In one embodiment, the electrolyte solution flows upwardly between the vertically mounted cathode and anode at a velocity in the range of about 0.1 to about 10 meters per second, and in one embodiment about 1 to about 4 meters per second, and in one embodiment about 2 to about 3 meters per second.

During the electrodeposition of copper, the electrolyte solution can optionally contain one or more active sulfur-containing materials. The term "active-sulfur containing material" refers to materials characterized generally as containing a bivalent sulfur atom both bonds of which are directly connected to a carbon atom together with one or more nitrogen atoms also directly connected to the carbon atom. In this group of compounds, the double bond may in some cases exist or alternate between the sulfur or nitrogen atom and the carbon atom. Thiourea is a useful active sulfur-containing material. The thioureas having the nucleus

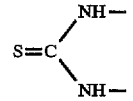

and the iso-thiocyanates having the grouping S═C═N— are useful. Thiosinamine (allyl thiourea) and thiosemicarbazide are also useful. The active sulfur-containing material should be soluble in the electrolyte solution and be compatible with the other constituents. The concentration of active sulfur-containing material in the electrolyte solution during electrodeposition is in one embodiment preferably up to about 20 ppm, and in the range of about 0.1 to about 15 ppm.

The copper electrolyte solution can also optionally contain one or more gelatins. The gelatins that are useful herein are heterogeneous mixtures of water-soluble proteins derived from collagen. Animal glue is a preferred gelatin because it is relatively inexpensive, commercially available and convenient to handle. The concentration of gelatin in the electrolyte solution is generally up to about 20 ppm, and in one embodiment up to about 10 ppm, and in one embodiment in the range of about 0.2 to about 10 ppm.

The copper electrolyte solution can also optionally contain other additives known in the art for controlling the properties of the electrodeposited foil. Examples include saccharin, caffeine, molasses, guar gum, gum arabic, the polyalkylene glycols (e.g., polyethylene glycol, polypropylene glycol, polyisopropylene glycol, etc.), dithiothreitol, amino acids (e.g., proline, hydroxyproline, cysteine, etc.), acrylamide, sulfopropyl disulfide, tetraethylthiuram disulfide, benzyl chloride, epichlorohydrin, chlorohydroxylpropyl sulfonate, alkylene oxides (e.g., ethylene oxide, propylene oxide, etc.), the sulfonium alkane sulfonates, thiocarbamoyldisulfide, selenic acid, or a mixture of two or more thereof. In one embodiment, these additives are used in concentrations of up to about 20 ppm, and in one embodiment up to about 10 ppm.

In one embodiment, the copper electrolyte solution is free of any organic additives.

During the electrodeposition of copper, it is preferred to maintain the ratio of applied current density (I) to diffusion limited current density ($I_L$) at a level of up to about 0.4, and in one embodiment up to about 0.3. That is, $I/I_L$ is preferably about 0.4 or less, and in one embodiment about 0.3 or less. The applied current density (I) is the number of amperes applied per unit area of electrode surface. The diffusion limited current density ($I_L$) is the maximum rate at which copper can be deposited. The maximum deposition rate is limited by how fast copper ions can diffuse to the surface of the cathode to replace those depleted by previous deposition. It can be calculated by the equation $$I_L = \frac{nFDC^{\circ}}{\delta(1-t)}$$

The terms used in the foregoing equation and their units are defined below:

| Symbol | Description | Units |
|---|---|---|
| I | Current Density | Amperes/cm$^2$ |
| $I_L$ | Diffusion Limited Current Density | Amperes/cm$^2$ |
| n | Equivalent Charge | Equivalents/mole |
| F | Faraday's Constant | 96487 (Amp)(second)/equivalent |

-continued

| Symbol | Description | Units |
|---|---|---|
| C° | Bulk Cupric Ion Concentration | Mole/cm$^3$ |
| D | Diffusion Coefficient | cm$^2$/second |
| δ | Concentration Boundary Layer Thickness | cm |
| t | Copper transfer number | dimensionless |

The boundary layer thickness δ is a function of viscosity, diffusion coefficient, and flow velocity. In one embodiment, the following parameter values are useful in electrodepositing copper foil:

| Parameter | Value |
|---|---|
| I (A/cm$^2$) | 1.0 |
| n (eq/mole) | 2 |
| D (cm$^2$/s) | $3.5 \times 10^{-5}$ |
| C° (mole/cm$^3$,$Cu^{+2}$ (as $CuSO_4$)) | $1.49 \times 10^{-3}$ |
| Temperature (°C.) | 60 |
| Free sulfuric acid (g/l) | 90 |
| Kinematic Viscosity (cm$^2$/s) | 0.0159 |
| Flow rate (cm/s) | 200 |

In one embodiment, a rotating cathode is used and copper foil is peeled off the cathode as it rotates. The foil is cut using one or several cutting steps to form a plurality of strands or ribbons of copper having cross-sections that are approximately rectangular in shape. In one embodiment, two sequential cutting steps are used. In one embodiment, the foil has a thickness in the range of about 0.001 to about 0.050 inch, or about 0.004 to about 0.010 inch. The foil is cut into strands having widths of about 0.25 to about 1 inch, or about 0.3 to about 0.7 inch, or about 0.5 inch. These strands are then cut to widths that are about 1 to about 3 times the thickness of the foil, and in one embodiment the width to thickness ratio is about 1.5:1 to about 2:1. In one embodiment a 6-ounce foil is cut into a strand having a cross-section of about 0.008×0.250 inch, then cut to a cross-section of about 0.008×0.012 inch. The strand is then rolled or drawn to provide the strand with a desired cross sectional shape and size.

In one embodiment, the copper is electrodeposited on a rotating cathode, which is in the form of a cylindrical mandrel, until the thickness of the copper on the cathode is from about 0.005 to about 0.050 inch, or about 0.010 to about 0.030 inch, or about 0.020 inch. Electrodeposition is then discontinued and the surface of the copper is washed and dried. A score cutter is used to cut the copper into a thin strand of copper which is then peeled off the cathode. The score cutter travels along the length of the cathode as the cathode rotates. The score cutter preferably cuts the copper to within about 0.001 inch of the cathode surface. The width of the strand of copper that is cut is, in one embodiment, from about 0.005 to about 0.050 inch, or from about 0.010 to about 0.030 inch, or about 0.020 inch. In one embodiment, the copper strand has a square or substantially square cross-section that is from about 0.005×0.005 inch to about 0.050×0.050 inch, or about 0.010×0.010 inch to about 0.030×0.030 inch, or about 0.020×0.020 inch. The strand of copper is then rolled or drawn to provide it with a desired cross-sectional shape and size.

Figure 3:
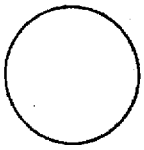
FIGS. 3–20 illustrate cross sectional shapes of wires made in accordance with the invention.
Figure 4:
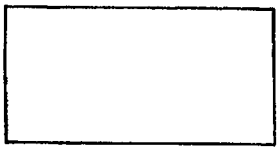
Figure 5:
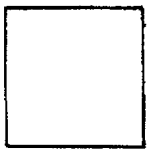
Figure 6:
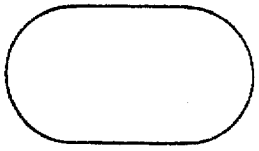
Figure 7:
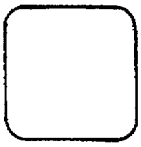
Figure 8:
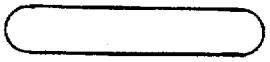
Figure 9:
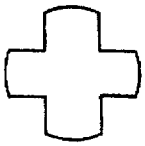
Figure 10:
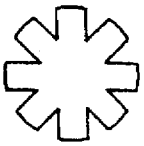
Figure 11:
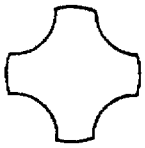
Figure 12:
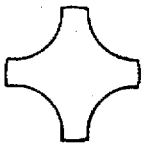
Figure 13:
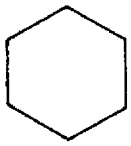
Figure 14:
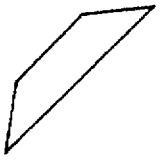
Figure 15:
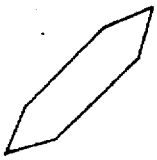
Figure 16:
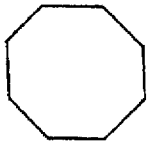
Figure 17:
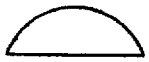
Figure 18:
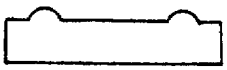
Figure 19:
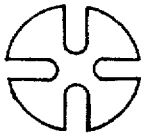
Figure 20:
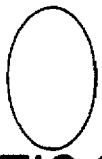

Generally, the metal wire made in accordance with the invention can have any cross-sectional shape that is conventionally available. These include the cross sectional shapes illustrated in FIGS. 3–20. Included are round cross sections (FIG. 3), squares (FIGS. 5 and 7), rectangles (FIG. 4), flats (FIG. 8), ribbed flats (FIG. 18), race tracks (FIG. 6), polygons (FIGS. 13–16), crosses (FIGS. 9, 11, 12 and 19), stars (FIG. 10), semi-circles (FIG. 17), ovals (FIG. 20), etc. The edges on these shapes can be sharp (e.g., FIGS. 4, 5, 13–16) or rounded (e.g., FIGS. 6–9, 11 and 12). These wires can be made using one or a series of Turks heads mills to provide the desired shape and size. They can have cross sectional diameters or major dimensions in the range of about 0.0002 to about 0.02 inch, and in one embodiment about 0.001 to about 0.01 inch, and in one embodiment about 0.001 to about 0.005 inch.

In one embodiment, the strands of metal wire are rolled using one or a series of Turks heads shaping mills wherein in each shaping mill the strands are pulled through two pairs of opposed rigidly-mounted forming rolls. In one embodiment, these rolls are grooved to produce shapes (e.g., rectangles, squares, etc.) with rounded edges. Powered Turks head mills wherein the rolls are driven can be used. The Turks head mill speed can be about 100 to about 5000 feet per minute, and in one embodiment about 300 to about 1500 feet per minute, and in one embodiment about 600 feet per minute.

In one embodiment, the wire strands are subjected to sequential passes through three Turks head mills to convert a wire with a rectangular cross section to a wire with a square cross section. In the first, the strands are rolled from a cross-section of 0.005×0.010 inch to a cross-section of 0.0052×0.0088 inch. In the second, the strands are rolled from a cross-section of 0.0052×0.0088 inch to a cross-section of 0.0054×0.0070 inch. In the third, the strands are rolled from a cross-section of 0.0054×0.0070 inch to a cross-section of 0.0056×0.0056 inch.

In one embodiment, the strands are subjected to sequential passes through two Turks head mills. In the first, the strands are rolled from a cross-section of 0.008×0.010 inch to a cross-section of 0.0087×0.0093 inch. In the second, the strands are rolled from a cross-section of 0.0087×0.0093 inch to a cross-section of 0.0090×0.0090 inch.

The strands of wire can be cleaned using known chemical, mechanical or electropolishing techniques. In one embodiment, strands of copper wire, which are cut from copper foil or are score cut and peeled off the cathode, are cleaned using such chemical, electropolishing or mechanical techniques before being advanced to Turks head mills for additional shaping. Chemical cleaning can be effected by passing the wire through an etching or pickling bath of nitric acid or hot (e.g., about 25° C. to 70° C.) sulfuric acid. Electropolishing can be effected using an electric current and sulfuric acid. Mechanical cleaning can be effected using brushes and the like for removing burrs and similar roughened portions from the surface of the wire. In one embodiment, the wire is degreased using a caustic soda solution, washed, rinsed, pickeled using hot (e.g., about 35° C.) sulfuric acid, electropolished using sulfuric acid, rinsed and dried.

In one embodiment, the strands of metal wire that are made in accordance with the invention have relatively short lengths (e.g., about 500 to about 5000 ft, and in one embodiment about 1000 to about 3000 ft, and in one embodiment about 2000 ft), and these strands of wire are welded to other similarly produced strands of wire using known techniques (e.g., butt welding) to produce strands of wire having relatively long lengths (e.g., lengths in excess of about 100,000 ft, or in excess of about 200,000 ft, up to about 1,000,000 ft or more).

In one embodiment, the strands of wire that are made in accordance with the invention are drawn through a die to provide the strands with round cross-sections. The die can be a shaped (e.g., square, oval, rectangle, etc.)-to-round pass die wherein the incoming strand of wire contacts the die in the drawing cone along a planar locus, and exits the die along a planar locus. The included die angle, in one embodiment, is about 8°, 12°, 16°, 24° or others known in the art. In one embodiment, prior to being drawn, these strands of wire are cleaned and welded (as discussed above). In one embodiment, a strand of wire having a square cross-section of 0.0056×0.0056 inch is drawn through a die in a single pass to provide a wire with a round cross-section and a cross-sectional diameter of 0.0056 inch (AWG 35). The wire can then be further drawn through additional dies to reduce the diameter.

The drawn metal wire, especially copper wire, produced in accordance with the inventive process has, in one embodiment, a round cross section and a diameter in the range of about 0.0002 to about 0.02 inch, and in one embodiment about 0.001 to about 0.01 inch, and in one embodiment about 0.001 to about 0.005 inch.

In one embodiment, the metal wire is coated with one or more of the following coatings:

| | |
|---|---|
| (1) Lead, or lead alloy (80 Pb—20Sn) | ASTM B189 |
| (2) Nickel | ASTM B355 |
| (3) Silver | ASTM B298 |
| (4) Tin | ASTM B33 |

These coatings are applied to (a) retain solderability for hookup-wire applications, (b) provide a barrier between the metal and insulation materials such as rubber, that would react with the metal and adhere to it (thus making it difficult to strip insulation from the wire to make an electrical connection) or (c) prevent oxidation of the metal during high-temperature service.

Tin-lead alloy coatings and pure tin coatings are the most common; nickel and silver are used for specialty and high-temperature applications.

The metal wire can be coated by hot dipping in a molten metal bath, electroplating or cladding. In one embodiment, a continuous process is used; this permits "on line" coating following the wire-drawing operation.

Stranded wire can be produced by twisting or braiding several wires together to provide a flexible cable. Different degrees of flexibility for a given current-carrying capacity can be achieved by varying the number, size and arrangement of individual wires. Solid wire, concentric strand, rope strand and bunched strand provide increasing degrees of flexibility; within the last three categories, a larger number of finer wires can provide greater flexibility.

Stranded wire and cable can be made on machines known as "bunchers" or "stranders." Conventional bunchers are used for stranding small-diameter wires (34 AWG up to 10 AWG). Individual wires are payed off reels located alongside the equipment and are fed over flyer arms that rotate about the take-up reel to twist the wires. The rotational speed of the arm relative to the take-up speed controls the length of lay in the bunch. For small, portable, flexible cables, individual wires are usually 30 to 44 AWG, and there may be as many as 30,000 wires in each cable.

A tubular buncher, which has up to 18 wire-payoff reels mounted inside the unit, can be used. Wire is taken off each reel while it remains in a horizontal plane, is threaded along a tubular barrel and is twisted together with other wires by a rotating action of the barrel. At the take-up end, the strand passes through a closing die to form the final bunch configuration. The finished strand is wound onto a reel that also remains within the machine.

In one embodiment, the wire is coated or covered with an insulation or jacketing. Three types of insulation or jacketing materials can be used. These are polymeric, enamel, and paper-and-oil.

In one embodiment, the polymers that are used are polyvinyl chloride (PVC), polyethylene, ethylene propylene rubber (EPR), silicone rubber, polytetrafluoroethylene (PTFE) and fluorinated ethylene propylene (FEP). Polyamide coatings are used where fire-resistance is of prime importance, such as in wiring harnesses for manned space vehicles. Natural rubber can be used. Synthetic rubbers can be used wherever good flexibility must be maintained, such as in welding or mining cable.

Many varieties of PVC are useful. These include several that are flame-resistant. PVC has good dielectric strength and flexibility, and is particularly useful because it is one of the least expensive conventional insulating and jacketing materials. It is used mainly for communication wire, control cable, building wire and low-voltage power cables. PVC insulation is normally selected for applications requiring continuous operation at low temperatures up to about 75° C.

Polyethylene, because of its low and stable dielectric constant, is useful when better electrical properties are required. It resists abrasion and solvents. It is used chiefly for hookup wire, communication wire and high-voltage cable. Crosslinked polyethylene (XLPE), which is made by adding organic peroxides to polyethylene and then vulcanizing the mixture, yields better heat-resistance, better mechanical properties, better aging characteristics, and freedom from environmental stress cracking. Special compounding can provide flame-resistance in cross-linked polyethylene. The usual maximum sustained operating temperature is about 90° C.

PTFE and FEP are used to insulate jet aircraft wire, electronic equipment wire and specialty control cables, where heat resistance, solvent resistance and high reliability are important. These electrical cables can operate at temperatures up to about 250° C.

These polymeric compounds can be applied over the wire using extrusion. The extruders are machines that convert pellets or powders of thermoplastic polymers into continuous covers. The insulating compound is loaded into a hopper that feeds it into a long, heated chamber. A continuously revolving screw moves the pellets into the hot zone, where the polymer softens and becomes fluid. At the end of the chamber, molten compound is forced out through a small die over the moving wire, which also passes through the die opening. As the insulated wire leaves the extruder it is water-cooled and taken up on reels. Wire jacketed with EPR and XLPE preferably go through a vulcanizing chamber prior to cooling to complete the cross-linking process.

Film-coated wire, usually fine magnet wire, generally comprises a copper wire coated with a thin, flexible enamel film. These insulated copper wires are used for electromagnetic coils in electrical devices, and must be capable of withstanding high breakdown voltages. Temperature ratings range from about 105° C. to about 220° C., depending on enamel composition. Useful enamels are based on polyvinyl acetals, polyesters and epoxy resins.

The equipment for enamel coating the wire is designed to insulate large numbers of wires simultaneously. In one embodiment, wires are passed through an enamel applicator that deposits a controlled thickness of liquid enamel onto the wire. Then the wire travels through a series of ovens to cure the coating, and finished wire is collected on spools. In order to build up a heavy coating of enamel, it may be necessary to pass wires through the system several times. Powdercoating methods are also useful. These avoid evolution of solvents, which is characteristic of curing conventional enamels, and thus make it easier for the manufacturer to meet OSHA and EPA standards. Electrostatic sprayers, fluidized beds and the like can be used to apply such powdered coatings.

Referring now to the illustrated embodiments, and initially to FIG. 1, a process for making copper wire is disclosed wherein copper is electrodeposited on a cathode to form a thin cylindrical sheath of copper around the cathode; this cylindrical sheath of copper is then score cut to form a thin strand of copper wire which is peeled off the cathode and then shaped to provide the wire with a desired cross sectional shape and size (e.g., round cross section with a cross sectional diameter of about 0.0002 to about 0.02 inch). The apparatus used with this process includes an electroforming cell 10 that includes vessel 12, vertically mounted cylindrical anode 14, and vertically mounted cylindrical cathode 16. Vessel 12 contains Electrolyte solution 18. Also included are score cutter 20, Turks head shaping mill 22, die 24 and reel 26. Cathode 16 is shown in phantom submerged in electrolyte 18 in vessel 12; it is also shown removed from vessel 12 adjacent score cutter 20. When cathode 16 is in vessel 12, anode 14 and cathode 16 are coaxially mounted with cathode 16 being positioned within anode 14. Cathode 16 rotates at a tangential velocity of up to about 400 meters per second, and in one embodiment about 10 to about 175 meters per second, and in one embodiment about 50 to about 75 meters per second, and in one embodiment about 60 to about 70 meters per second. The electrolyte solution 18 flows upwardly between the cathode 16 and anode 14 at a velocity in the range of about 0.1 to about 10 meters per second, and in one embodiment about 1 to about 4 meters per second, and in one embodiment about 2 to about 3 meters per second.

A voltage is applied between anode 14 and cathode 16 to effect electrodeposition of the copper on to the cathode. In one embodiment, the current that is used is a direct current, and in one embodiment it is an alternating current with a direct current bias. Copper ions in electrolyte 18 gain electrons at the peripheral surface 17 of cathode 16 whereby metallic copper plates out in the form of a cylindrical sheath of copper 28 around on the surface 17 of cathode 16. Electro-deposition of copper on cathode 16 is continued until the thickness of the copper sheath 28 is at a desired level, e.g., about 0.005 to about 0.050 inch. Electrodeposition is then discontinued. The cathode 16 is removed from the vessel 12. Copper sheath 28 is washed and dried. Score cutter 20 is then activated to cut copper sheath 28 into a thin continuous strand 30. Score cutter 20 travels along screw 32 as cathode 16 is rotated about its center axis by support and drive member 34 . Rotary blade 35 cuts copper sheath 28 to within about 0.001 inch of the surface 17 of cathode 16. Wire strand 36, which has a rectangular cross-section, is peeled off cathode 16, advanced through Turks head mill 22 wherein it is rolled to convert the cross sectional shape of the wire strand to a square shape. The wire is then drawn through die 24 wherein the cross sectional shape is converted to a round cross-section. The wire is then wound on reel 26.

The process depletes the electrolyte solution 18 of copper ions and organic additives. These ingredients are continuously replenished. Electrolyte solution 18 is withdrawn from vessel 12 through line 40 and recirculated through filter 42, digester 44 and filter 46, and then is reintroduced into vessel 12 through line 48. Sulfuric acid from vessel 50 is advanced to digester 44 through line 52. Copper from a source 54 is introduced into digester 44 along path 56. In one embodiment, the copper that is introduced into digester 44 is in the form of copper shot, scrap copper wire, copper oxide or recycled copper. In digester 44, the copper is dissolved by the sulfuric acid and air to form a solution containing copper ions.

Organic additives are added to the recirculating solution in line 40 from a vessel 58 through line 60. In one embodiment, active sulfur-containing material is added to the recirculating solution in line 48 through line 62 from a vessel 64. The addition rate for these organic additives is, in one embodiment, in the range of up to about 14 mg/min/kA, and in one embodiment about 0.2 to about 6 mg/min/kA, and in one embodiment about 1.5 to about 2.5 mg/min/kA. In one embodiment, no organic additives are added.

Figure 2:
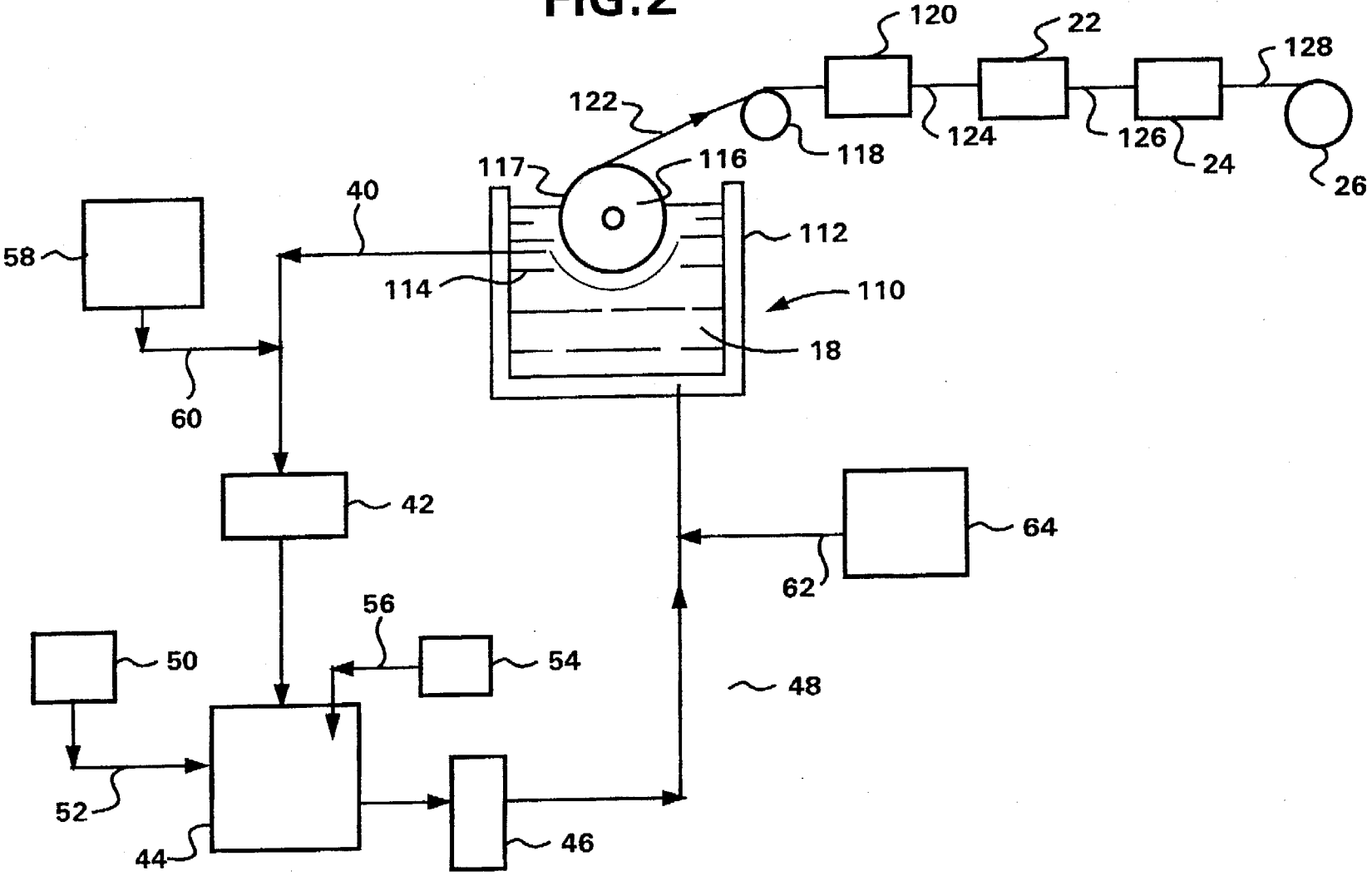
FIG. 2 is a flow sheet illustrating another embodiment of the invention wherein copper is electrodeposited on a horizontally oriented cathode to form copper foil, and then the foil is removed from the cathode, cut to form one or more strands of copper wire, and then the strands of copper wire are shaped to form copper wire with desired cross-sectional shapes and sizes.

The illustrated embodiment disclosed in FIG. 2 is identical to the embodiment disclosed in FIG. 1 except that electroforming cell 10 in FIG. 1 is replaced by electroforming cell 110 in FIG. 2; vessel 12 is replaced by vessel 112; cylindrical anode 14 is replaced by curved anode 114; vertically mounted cylindrical cathode 16 is replaced by horizontally mounted cylindrical cathode 116; and score cutter 20, screw 32 and support and drive member 34 are replaced by roller 118 and slitter 120.

In the electroforming cell 110, a voltage is applied between anode 114 and cathode 116 to effect electrodeposition of copper on the cathode. In one embodiment, the current that is used is a direct current, and in one embodiment it is an alternating current with a direct current bias. Copper ions in electrolyte solution 18 gain electrons at the peripheral surface 117 of cathode 116 whereby metallic copper plates out in the form of a copper foil layer on surface 117. Cathode 116 rotates about its axis and the foil layer is withdrawn from cathode surface 117 as continuous web 122. The electrolyte is circulated and replenished in the same manner as described above for the embodiment disclosed in FIG. 1.

Copper foil 122 is peeled off cathode 116 and passes over roller 118 into and through slitter 120 wherein it is slit into a plurality of continuous strands 124 of copper wire having cross-sections that are rectangular or substantially rectangular in shape. In one embodiment, the copper foil 122 is advanced to slitter 120 in a continuous process. In one embodiment, the copper foil is peeled off cathode 116, stored in roll form, and then later advanced through the slitter. The rectangular strands 124 are advanced from slitter 120 through Turks head mill 22 wherein they are rolled to provide strands 126 having square cross-sections. Strands 126 are then drawn through die 24 wherein they are drawn to form copper wire 128 with round cross-sections. Copper wire 128 is wound on reel 26.

The following examples are provided for purposes of illustrating the invention.

EXAMPLE 1

Electrodeposited copper foil having a weight of 6 oz/ft$^2$ is made in an electroforming cell using an electrolyte solution having a copper ion concentration of 50 grams per liter, and a sulfuric acid concentration of 80 grams per liter. The free chloride ion concentration is zero and no organic additives are added to the electrolyte. The foil is cut, then advanced through a Turks head mill and then drawn through a die to form copper wire.

EXAMPLE 2

Electrodeposited copper foil having a width of 84" inches, a thickness of 0.008" inch and a length of 600 feet is collected on a roll. The foil is reduced using a series of slitters from the original width of 84" to 0.25" wide ribbons. The first slitter reduces the width from 84" inches to 24", the second from 24" to 2", and the third from 2" to 0.25" inch. The 0.25" ribbons are slit to 0.012" wide ribbons. These ribbons, or slit-sheared copper wires, have a cross section of 0.008×0.012". This copper wire is prepared for metal shaping and forming operations. This consists of degreasing, washing, rinsing, pickling, electropolishing, rinsing, and drying. Single strands of wire are welded together and spooled for pay-off into further processing. The strands of wire are clean and burr-free. They are shaped to a round cross section using a combination of rolls and drawing dies. The first pass uses a miniaturized powered Turks head shaping mill to reduce the 0.012" dimension sides to approximately 0.010–0.011". The next pass is through a second Turks head mill wherein this dimension is further compressed to approximately 0.008–0.010", with the overall cross section being squared. Both passes are compressive, relative to the dimensions cited above, with an increase in the transverse dimension (the dimension in the cross section direction perpendicular to the direction of compression) and an increase in wire length. The edges are rounded with each pass. The wire is then passed through a drawing die wherein it is rounded and elongated having a diameter of 0.00795", AWG 32.

An advantage of this invention is that when the metallic foil, especially copper foil, is produced using electrodeposition, the properties of the wire made from such foil can be controlled to a great extent by the composition of the electrolyte solution. Thus, for example, electrolyte solutions containing no organic additives and having a free chloride ion concentration of below 1 ppm, and in one embodiment zero or substantially zero, are particularly suitable for producing ultra thin copper wire (e.g., AWG 25 to about AWG 60, and in one embodiment AWG 55).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for making metal wire, comprising:

(A) forming a thin web of metal foil having a thickness of about 0.001 to about 0.05 inch, said metal being selected from the group consisting of copper, gold, silver, tin, chromium, zinc, nickel, platinum, palladium, iron, aluminum, steel, lead, brass, or an alloy of one or more of the foregoing metals;

(B) cutting said foil to form at least one strand of wire; and (C) shaping said strand of wire to provide said strand with desired cross-sectional shape and size.

2. The process of claim 1 wherein said metal is an alloy selected from the group consisting of copper/zinc, copper/silver, copper/tin/zinc, copper/phosphorus, chromium/molybdenum, nickel/chromium and nickel/phosphorus.

3. The process of claim 1 wherein said metal is copper or a copper-based alloy.

4. The process of claim 1 wherein said metal foil is wrought copper foil.

5. The process of claim 1 with the step of cleaning said strand of wire from step (B) prior to step (C).

6. The process of claim 1 wherein said wire has a round cross-sectional shape.

7. The process of claim 1 wherein said wire has a square or rectangular cross-sectional shape.

8. The process of claim 1 wherein said wire has a cross-sectional shape in the form of a cross, star, semi-circle, polygon, race track, oval, flat or ribbed-flat.

9. The process of claim 1 wherein said wire has a cross-sectional shape in a form substantially as illustrated in any one of FIGS. 3–20.

10. The process of claim 1 wherein said metal foil is electro-deposited copper foil.

11. The process of claim 10 wherein said foil is formed in an electroforming cell comprising an anode and a cathode, said cathode being horizontally mounted.

12. The process of claim 10, wherein said foil is formed in an electroforming cell comprising an anode and a cathode, said cathode being vertically mounted.

13. The process of claim 10 wherein said forming step (A) comprises flowing an electrolyte solution between an anode and a cathode and applying an effective amount of voltage across said anode and said cathode to deposit copper foil on said cathode.

14. The process of claim 13 wherein said electrolyte solution has a free chloride ion concentration of up to about 5 ppm.

15. The process of claim 13 wherein said electrolyte solution has a free chloride ion concentration of up to about 1 ppm.

16. The process of claim 13 wherein said electrolyte solution has a free chloride ion concentration of zero.

17. The process of claim 13 wherein said electrolyte solution is free of organic additives.

18. The process of claim 13 wherein said electrolyte solution further comprises at least one organic additive.

19. The process of claim 18 wherein said organic additive is a gelatin or an active sulfur containing material.

20. The process of claim 18 wherein said organic additive is selected from the group consisting of saccharin, caffeine, molasses, guar gum, gum arabic, polyethylene glycol, polypropylene glycol, polyisopropylene glycol, dithiothreitol, proline, hydroxyproline, cysteine, acrylamide, sulfopropyl disulfide, tetraethylthiuram disulfide, benzyl chloride, epichlorohydrin, chlorohydroxylpropylsulfonate, ethylene oxide, propylene oxide, sulfonium alkane sulfonate, thiocarbamoyldisulfide and selenic acid.

21. The process of claim 13 wherein said electrolyte solution has a copper ion concentration in the range of about 40 to about 150 grams per liter, a free sulfuric acid concentration in the range of about 70 to about 170 grams per liter, and a chloride ion concentration of up to about 5 ppm.

22. The process of claim 13 wherein the current density during step (A) is in the range of about 50 to about 3000 amps per square foot.

23. The process of claim 13 wherein the flow velocity of electrolyte between said anode and said cathode is in the range of about 0.2 to about 5 meters per second.

24. A process for making copper wire, comprising:

(A) forming a thin web of copper foil having a thickness of about 0.001 to about 0.05 inch;

(B) cutting said foil to form at least one strand of copper wire; and (C) shaping said strand of copper wire to provide said strand with desired cross-sectional shape and size.

25. A process for making copper wire comprising:

(A) flowing an electrolyte solution between an anode and a cathode in an electroforming cell and applying an effective amount of voltage across said anode and said cathode to deposit copper on said cathode, said electrolyte solution being characterized by a free chloride ion concentration of up to about 5 ppm;

(B) score-cutting said copper to form a strand of copper wire and removing said strand of copper from said cathode; and (C) shaping said strand of copper wire to provide copper wire with desired cross-sectional shape and size.

26. A process for making copper wire comprising:

(A) flowing an electrolyte solution between an anode and a cathode in an electroforming cell and applying an effective amount of voltage across said anode and said cathode to deposit a thin web of copper foil having a thickness of about 0.001 to about 0.05 inch on said cathode, said electrolyte solution being characterized by a free chloride ion concentration of up to about 5 ppm;

(B) removing said copper foil from said cathode;

(C) cutting said copper foil to form at least one strand of copper wire; and (D) shaping said strand of copper wire to provide copper wire with desired cross-sectional shape and size.

27. A process for making metal wire, comprising:.

(A) forming metal foil;

(B) cutting said foil to form at least one strand of wire; and (C) shaping said strand of wire to provide said strand with desired cross-sectional shape and size;

wherein said metal foil is electrodeposited copper foil and is formed in an electroforming cell on a cathode during step (A), and said cutting step (B) comprises score cutting said foil while on said cathode to form said strand of wire and removing said strand from said cathode.

28. The process of claim 27 wherein prior to step (B), said cathode is removed from said electroforming cell.

* * * * *